United States Patent [19]

Hollowell et al.

[11] Patent Number: 5,004,132

[45] Date of Patent: Apr. 2, 1991

[54] METHOD AND APPARATUS FOR PRODUCING SOCKS

[75] Inventors: George E. Hollowell, Hildebran; Hugh D. Sample, Newton, both of N.C.

[73] Assignee: Neuville Industries, Inc., Hildebran, N.C.

[21] Appl. No.: 468,751

[22] Filed: Jan. 24, 1990

[51] Int. Cl.[5] ..... A41H 43/00; D05B 65/00

[52] U.S. Cl. ..... 223/1; 223/75; 112/287; 112/DIG. 1; 28/295; 66/147

[58] Field of Search ..... 223/1, 75; 112/287, 112/DIG. 1; 28/295; 66/147

[56] References Cited

U.S. PATENT DOCUMENTS

| | | | |
|---|---|---|---|
| 2,525,111 | 10/1950 | Astphan | 223/76 |
| 2,838,217 | 6/1958 | Bowman | 223/1 |
| 3,465,702 | 9/1969 | Iizuka | 112/287 |
| 4,459,830 | 7/1984 | Tsuchiya et al. | 66/147 |

FOREIGN PATENT DOCUMENTS

| | | | |
|---|---|---|---|
| 2417325 | 4/1974 | Fed. Rep. of Germany | 112/DIG. 1 |
| 152870 | 3/1963 | U.S.S.R. | 223/1 |
| 2096196 | 4/1981 | United Kingdom | 223/75 |

*Primary Examiner*—Werner H. Schroeder
*Assistant Examiner*—Bibhu Mohanty
*Attorney, Agent, or Firm*—Eckert Seamans Cherin & Mellott

[57] ABSTRACT

A method and apparatus for finishing socks is disclosed which utilizes a boarding or blocking machine of the type having a plurality of sock boarding (blocking) forms which are movable within a track. Socks to be block (boarded) are applied to the boarding forms with a free yarn end or string still attached to each sock. Clipping assemblies are mounted on either side of the track in position to automatically sever the extending string as each boarding form moves past the clipping assemblies. A vacuum system is associated with each clipping assembly to continuously remove the severed strings and other loose materials resulting from the clipping operations. By employing the clipping asemblies in combination with and in association with the boarding machine, the previously required, separate, string severing operations can be eliminated.

17 Claims, 2 Drawing Sheets

METHOD AND APPARATUS FOR PRODUCING SOCKS

BACKGROUND OF THE INVENTION

1. Field of the Invention

The invention relates generally to the field of manufacturing hosiery, for example, socks, and more particularly, is directed to an improved, more efficient and cost effective method and apparatus for finishing socks.

2. Background of the Invention

When manufacturing socks, it is now the common practice to knit quantities of socks in the greige using known, automatic equipment. Then the knitted socks are bleached and dyed in bulk as required to rapidly produce pluralities of similar socks having the predetermined final color. The socks are preliminarily dried in suitable drying apparatus and the knitted, dried, socks are then transported to the boarding room for introduction into automatic boarding or blocking machines wherein they are boarded, counted, pressed and stacked in prepackaging bundles. One known type of automatic blocking or boarding machine suitable for this purpose is manufactured by Autoboard Corporation, Charlotte, N.C. and sold under the trademark "Autoboard".

The socks that are knitted and boarded (blocked) by these known prior art processes are characterized in that a short, free end of yarn remains at the top of the sock at the location where each sock was separated from the automatic knitting machine upon completion of the sock knitting process. Inasmuch as such an extending yarn or string is objectionable in the marketplace and would present a somewhat unfinished appearance to a prospective purchaser, it is now a necessary practice to clip each string at a final work station just prior to or simultaneously with the packaging process.

While each string could be severed individually by employing a sharp implement such as a knife or a pair of scissors in the usual manner, such individual, manual operations have proved to be too time consuming and therefore too costly for use in today's highly competitive and cost oriented sock market. Accordingly, it is now the accepted practice to utilize electric clippers or shears for this purpose. The cutting heads of the clippers are applied to the tops of prepackaged bundles comprising six or twelve socks wherein all six or all twelve of the extending strings can be removed at substantially the same time in a much simpler and more time effective procedure. Usually, a vacuum system has been associated with the electric clippers wherein all debris including the severed yarn ends or strings can be immediately swept by suction forces into the vacuum system to thereby safely provide a convenient point of disposal for all loose materials.

While the clipping of the yarn ends or strings is an important and necessary operation in order to produce an acceptable, first quality, desirable product, the very steps necessary to produce the final, finished product, that is, the steps of prepackaging the previously boarded socks into bundles, transporting the sock bundles to a work station and then employing one or more operators at that work station to operate electric clippers to sever or clip the remaining yarn ends or strings does present an additional cost factor that must be considered when calculating the exact production costs for each particular style of socks.

It will be appreciated that the field of sock manufacturing is extremely competitive, both between competing United States manufacturers and also and more increasingly, between U.S. sock producers and foreign manufacturers. Accordingly, any economies in manufacturing and production that can be introduced into the sock producing procedures that will save any costs whatsoever have proved to be most welcome and most necessary.

SUMMARY OF THE INVENTION

The present invention relates generally to the field of manufacturing of socks, and more particularly, is directed to a method of manufacturing socks wherein clipping heads can be associated directly with the boarding machine for automatic operation in a manner to eliminate all separate, manual, string clipping procedure.

In accordance with the method of the present invention, existing automatic boarding machines are modified by providing electric clipping heads at the inlet or entrance to the boarding machine. Preferably, opposed clipping heads are positioned in spaced relationship wherein the boarding forms with the socks supported thereon are carried between the pairs of clipping heads in an automatic, timed, steady procedure as the socks enter the boarding machine. In this manner, the strings to be clipped will be drawn into contact with either the right clipping head or the left clipping head of the spaced pair, depending upon the position of the string to be severed in relation to the right side or the left side of the boarding form. Clipping heads suitable for the purpose are known in the art and may be similar to the electric clippers manufactured and sold by Buvris, Inc., Spartanburg, S.C.

Of course, socks are knitted in various lengths as required by style and size and the existing boarding forms are designed as universal forms to accommodate all lengths of socks. It is a feature of this invention to mount the clipping heads and the associated electric motors upon vertical adjustment brackets wherein the operating height of the clipping heads can be readily varied as may be required by the sock length of the socks entering the boarding machine. Accordingly, the clipping heads can be easily vertically positioned to assure clipping each end string or yarn as each boarding form with a sock mounted therein is moved between the spaced pair of clipping heads. In known manner, vacuum systems including height adjustable vacuum inlet hoses are provided in close association with the clipping heads to assure that the strings to be clipped will be drawn towards the clippers for proper cutting and to automatically lead the loose, severed materials to a proper point of disposal without causing air or plant contamination.

In a preferred embodiment, the clippers and motors are secured to adjustment brackets which are mounted for vertical adjustment within vertical tracks. Means, such as adjustment chains, can be provided to easily manually adjust the elevation of the motor brackets within the tracks. The motors and their associated clipping heads can then be secured in any desired vertically adjusted position as necessary to position each clipping head immediately laterally adjacent to the strings to be clipped as the socks on the boarding forms are carried past the spaced pairs of clippers upon normal operation of the boarding machine.

It is therefore it is an object of the present invention to provide an improved method and apparatus for producing socks of the type set forth.

It is another object of the present invention to provide a novel method of producing socks which includes positioning electric clipping heads on opposite sides of moving boarding forms at the boarding form entrance of a boarding machine, vertically adjusting the clipping heads to the height of the strings to be severed from socks previously applied to each boarding form, applying vacuum forces adjacent to each clipping head to draw the strings to be clipped toward the clippers and to remove all loose materials resulting from the clipping operations and then boarding the socks without loose strings in the boarding machine.

It is another object of the present invention to provide a novel method of producing socks comprising the steps of applying socks to be boarded serially to boarding forms of a conventional boarding machine and leaving a string to be clipped extending from the top of each sock; mounting motorized electric clipping heads on either side of the path of the boarding forms; transporting each sock on a boarding form between opposed pairs of clipping heads; severing the strings with the clipping heads; vacuuming each severed string and transporting the severed strings to a point of disposal; boarding each sock without the extending string in the boarding machine; and counting and stacking the boarded, clipped socks at the exit from the boarding machine for subsequent packaging.

It is another object of the present invention to provide a novel method of producing socks that is simple in concept, inexpensive in setup and automatic and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 3:
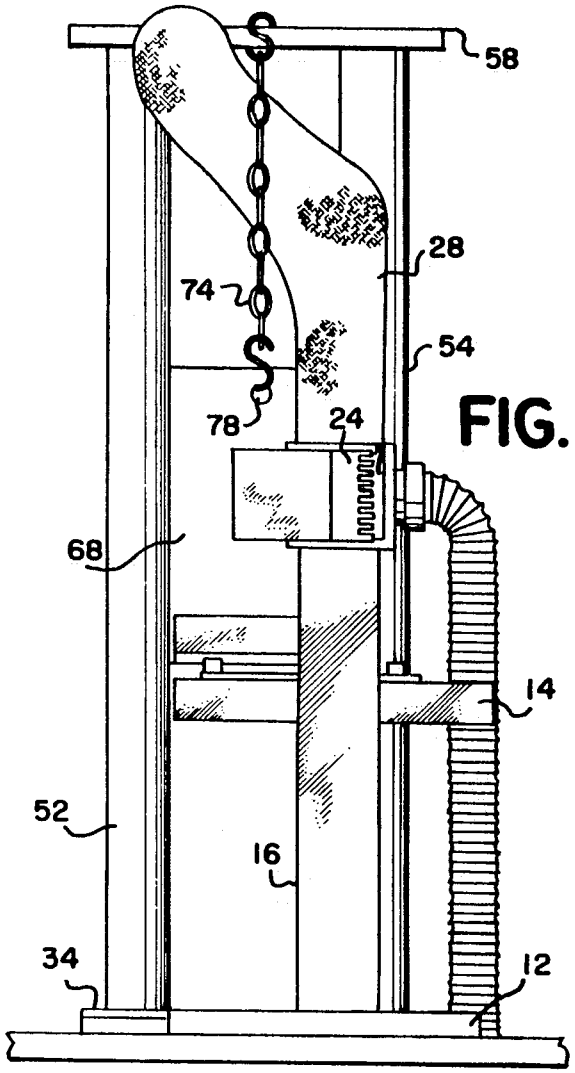
FIG. 3 is cross sectional view looking from line 3—3 on FIG. 1, in the direction of the arrows.

Although specific terms are used in the following description for the sake of clarity, these terms are intended to refer only to the particular structure of invention selected for illustration in the drawings, and are not intended to define or limit the scope of the invention.

Figure 1:
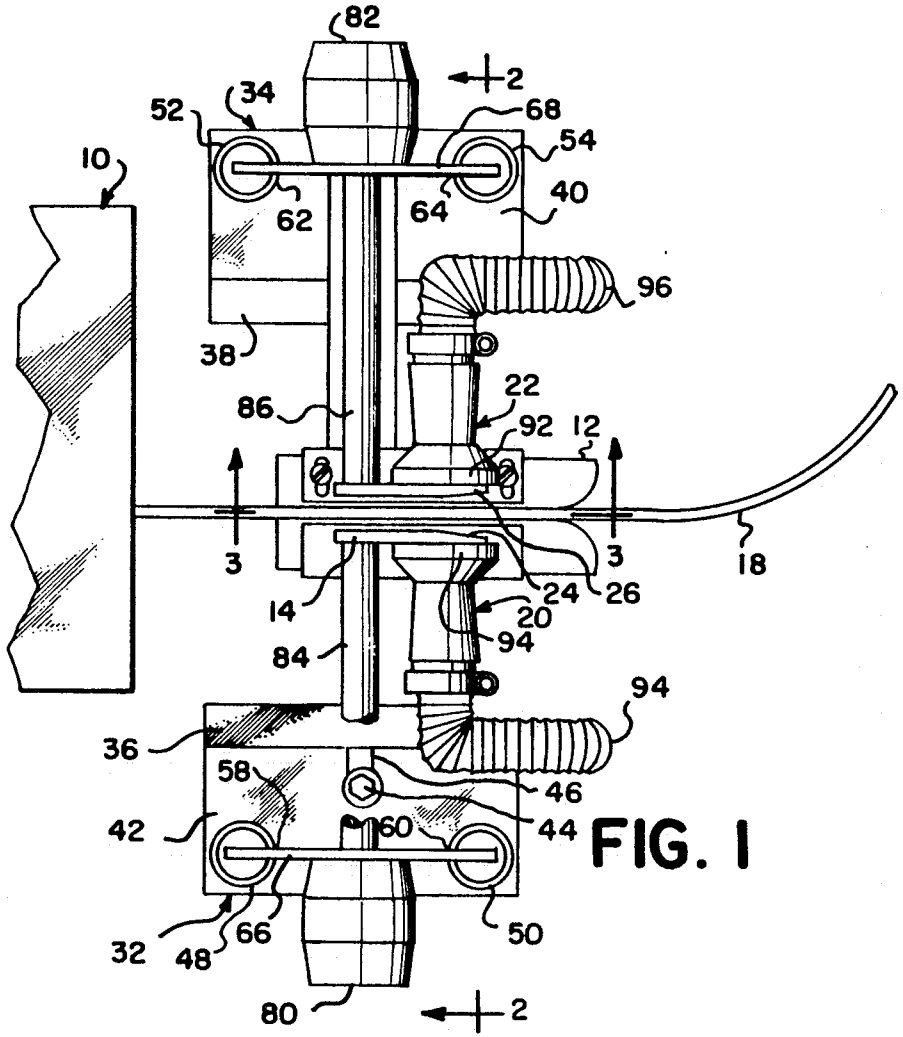
FIG. 1 is a partial, top plan view showing clipping heads mounted in accordance with the teachings of the present invention arranged at the boarding form inlet of a conventional boarding machine.

Referring now to the drawings, there is shown in FIG. 1 a partial view of a conventional blocking or boarding machine 10 which includes pairs of lower and upper guides 12, 14 to direct and guide a plurality of similar, flat, shaped, sock blocking or boarding forms 16 into the form entrance of a boarding (blocking) machine as the sock boarding forms are directed along the lower endless track 18 in conventional manner.

Figure 2:
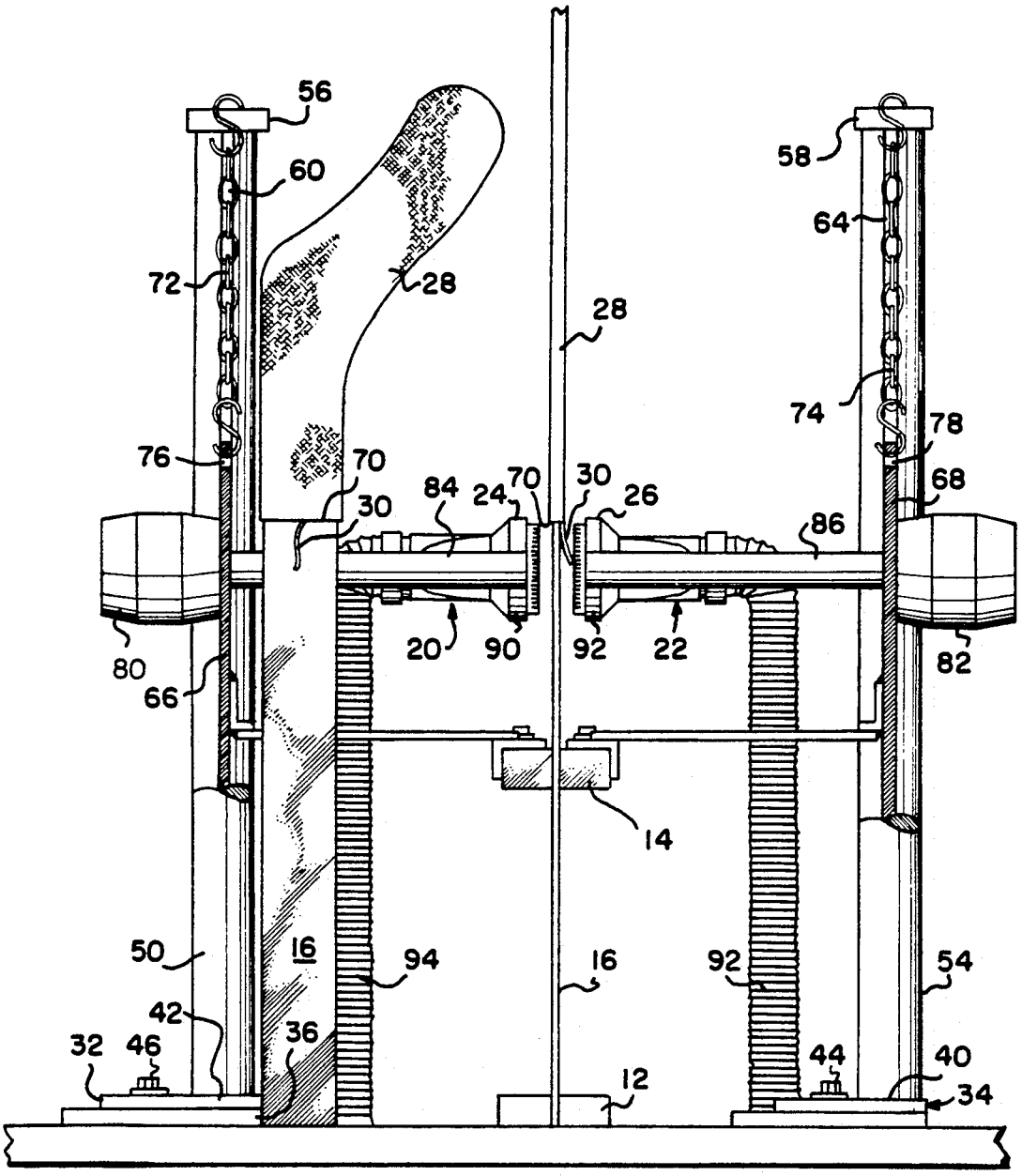
FIG. 2 is an enlarged, partial, side elevational view looking from line 2—2 on FIG. 1, in the direction of the arrows.

Still referring to FIG. 1 and further considering FIGS. 2 and 3, left and right, similar electric clipping head assemblies 20, 22 are provided at the boarding form entrance whereby opposed, spaced clipping heads 24, 26 are mounted on either side of the path of the movable sock boarding forms. The clipper heads are secured in close proximity to the sides of the boarding forms as each boarding form 16 is guided to enter the interior of the boarding machine 10 for drying and shaping the socks 28. In accordance with existing practice, each sock 28 is knit in the greige at the knitting mill (not shown) and is then transported to the boarding area. The socks are then applied individually over boarding forms 16 for boarding within the boarding machine 10. As previously set forth, each previously knit sock 28 includes a short length of extending yarn or string 30 as it leaves the sock knitting machine (not shown) and it is this string that must be removed prior to inspection and packaging of the finished product.

Left and right bracket assemblies 32, 34 secure to the boarding machine frame on each side of the lower track 18 adjacent to the form entrance to the boarding machine wherein each boarding form 16 in turn will be directed between the left and right bracket assemblies 32, 34. Each of the bracket assemblies comprises a stationary base plate 36, 38 and a lateral adjustment plate 40, 42 secured to a base plate in a laterally adjustable manner. In the illustrated construction, a machine bolt 44 inserts through an elongated slot 46 provided in each adjustment plate 40, 42 and threadedly engaged in a threaded opening provided in a base plate 36, 38. This permits the clipper heads to be easily laterally adjusted closer to or further away from the socks 28 as they are guided past the left and right clipping assemblies 20, 22. Pairs of spaced, vertical supports 48, 50 and 52, 54 extend respectively upwardly from the adjustment plates 40, 42 and terminate upwardly in left and right support webs 56, 58.

Each vertical support 48, 50, 52, 54 is provided with a track 58, 60, 62, 64 to form pairs of transversely opposed, facing slots or tracks which receive therein left and right clipping assembly support plates 66, 68. The clipping assembly support plates are vertically slideable within the left and right track pairs 58, 60 and 62, 64 to facilitate positioning the left and right clipping assemblies 20, 22 at the correct height to remove the strings or yarn ends 30 which remain at the tops 70 of the socks 28 upon completion of the sock knitting procedures. In a preferred construction, a support chain 72, 74 connects at one end to each clipping assembly support plate 66, 68 at an opening 76, 78 and is adjustably secured upwardly to a support web 56, 58. By adjusting and securing the length of chain 72, 74 supported by a web 56, 58, the vertical position of each clipper assembly 20,22 can be quickly set to properly function with the length of the socks being processed through the boarding machine 10 at any particular time.

Each clipper assembly 20, 22 comprises a clipper motor 80, 82, a conventional clipper head 24, 26 and a suitable interconnecting shaft 84, 86. A vacuum inlet 90 or 92 preferably is positioned immediately adjacent to each clipper head 24, 26. The vacuum inlets 90, 92 function to continuously draw the loose yarn ends 30 to the clipper heads 24, 26 for severing purposes and to remove all separated strings or yarn ends, all lint and any other loose materials which may result from the clipper operations. Lengths of flexible hose or tubing 94, 96 interconnect the vacuum inlets 90, 92 with a suitable source of vacuum (not shown) which preferably may be positioned immediately adjacent to the boarding machine. By providing a spaced pair of clipper assemblies 20, 22, the severing of the extending strings or yarns 30 will be assured no matter where the string may be positioned relative to the top 20 of a sock 28 without requiring any special attention to string location by the boarding machine operator.

Following boarding of the socks 28 with the strings previously severed, the socks can then be immediately counted and stacked for packaging, thereby eliminating the time and expense previously required by the manual string clipping operations.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus the scope of the invention should not be limited by the foregoing specification, but rather only by the scope of the claims appended hereto.

What is claimed is:

1. A method of finishing socks utilizing a blocking machine of the type having a plurality of movable, flat sock blocking forms to receive previously knit socks having a free yarn end and to transport the socks through the blocking machine, comprising the steps of:

providing a clipping head on each side of the blocking forms in position to contact the socks on the forms;

passing the sock blocking forms with socks respectively thereon between the clipping heads; and, operating the clipping heads to sever the free year end from each sock prior to blocking.

2. The method of claim 1 and the further step of supporting a clipping head on a vertically adjustable plate and adjusting the height of the plate to vertically position the clipping head when necessary to contact the free year end as each blocking form is moved past the clipping head.

3. The method of claim 2 wherein the adjusting means for the plate is manual.

4. The method of claim 1 and removing continuously each severed free year end.

5. The method of claim 4 wherein the removing is by vacuum.

6. The method of claim 5 and applying the vacuum to each side of the blocking form.

7. The method of claim 4 and the further step of laterally adjusting the adjustable plate as necessary to position the clipping head to contact the free yarn end as each blocking form is moved past the clipping head.

8. The method of claim 5 and the further step of laterally adjusting the adjustable plate to move the clipping head to a position necessary to contact the free yarn end as each boarding form is moved past the clipping head.

9. A method of finishing socks, comprising:

applying socks with free year ends serially to flat blocking forms of an automatic blocking machine;

positioning clipping heads on opposite sides of the blocking forms and vertically adjusting the clipping heads to the height of the free year ends;

moving the blocking forms with the socks thereon between the clipping heads and severing the free year ends; and, blocking the socks in the automatic blocking machine without the free yarn end.

10. The method of claim 9 and the further step of urging the free year ends toward the clipping heads.

11. The method of claim 10 wherein the urging is by vacuum forces.

12. The method of claim 11 the further step of removing the severed yarn ends with the vacuum forces.

13. In an automatic blocking machine of the type comprising an endless track, a plurality of flat, sock blocking forms movable with the endless track and means to block knit in the greige socks after the socks have been applied serially to the sock blocking forms, the improvement comprising:

bracket assembly means secured to the blocking machine on opposite sides of the endless track to position clipper heads adjacent to each flat side of the sock blocking forms, the bracket assembly means comprising vertical tracks; and, clipper assembly means carried by the bracket assembly means to permit vertical adjustment as required by the length of the socks being blocked, the clipper assembly means comprising a support plate, a motor carried by the support plate and a clipper head activated by the motor, the support plate being retained within the vertical tracks to permit vertical adjustment of the clipper head relative to the blocking forms.

14. The blocking machine of claim 13 and vacuum inlet means positioned adjacent to the clipper head, the vacuum inlet means being vertically adjustable simultaneously with vertical adjustment of the clipper head.

15. The blocking machine of claim 13 and means to laterally adjust each bracket assembly means toward or away from the endless track to move the clipper head closer to or further away from the sock blocking form.

16. The blocking machine of claim 15 wherein the bracket assembly means comprises a base plate, an adjustment plate adjustably movable over the base plate, a plurality of vertical supports extending from the adjustment plate, the vertical supports each being provided with one of said vertical tracks.

17. The blocking machine of claim 16 wherein pairs of vertical supports terminate upwardly in a connecting web and a manually adjustable chain interconnecting the support plate and the web to permit the clipper head to be secured in any desired vertically adjusted position relative to the sock blocking forms.

* * * * *